US011698228B2

(12) United States Patent
Numata et al.

(10) Patent No.: US 11,698,228 B2
(45) Date of Patent: Jul. 11, 2023

(54) SHELL-AND-PLATE HEAT EXCHANGER

(71) Applicant: DAIKIN INDUSTRIES, LTD., Osaka (JP)

(72) Inventors: Mitsuharu Numata, Osaka (JP); Kou Terai, Osaka (JP); Yutaka Shibata, Osaka (JP); Hirokazu Fujino, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/862,826

(22) Filed: Jul. 12, 2022

(65) Prior Publication Data

US 2022/0341675 A1 Oct. 27, 2022

Related U.S. Application Data

(63) Continuation of application No. PCT/JP2021/001023, filed on Jan. 14, 2021.

(30) Foreign Application Priority Data

Jan. 14, 2020 (JP) ..... 2020-003834

(51) Int. Cl.
*F28D 21/00* (2006.01)
*F28F 3/08* (2006.01)
(Continued)

(52) U.S. Cl.
CPC ..... *F28D 9/005* (2013.01); *F25B 39/022* (2013.01); *F28D 21/00* (2013.01); *F28F 3/08* (2013.01);
(Continued)

(58) Field of Classification Search
CPC ..... F28F 9/001; F28F 9/0273; F28D 9/0006; F28D 21/0017; F28D 1/0308;
(Continued)

(56) References Cited

U.S. PATENT DOCUMENTS 5,509,471 A 4/1996 Hallgren
5,561,987 A * 10/1996 Hartfield ..... F28D 3/02 165/117
(Continued)

FOREIGN PATENT DOCUMENTS

CN 104755873 A 7/2015
EP 2843324 A1 3/2015
(Continued)

OTHER PUBLICATIONS

English translation of the International Preliminary Report on Patentability issued in corresponding International Application No. PCT/JP2021/001023, dated Jul. 28, 2022 (7 pages).
(Continued)

*Primary Examiner* — Jianying C Atkisson
*Assistant Examiner* — For K Ling
(74) *Attorney, Agent, or Firm* — Osha Bergman Watanabe & Burton LLP

(57) ABSTRACT

A shell-and-plate heat exchanger includes: a shell forming an internal space; and a plate stack, disposed in the internal space, including heat transfer plates that are stacked and joined together. The shell-and-plate heat exchanger is configured to allow a refrigerant that has flowed into the internal space to evaporate. The plate stack forms: refrigerant channels that communicate with the internal space and through which a refrigerant flows; and heating medium channels that are blocked from the internal space and through which a heating medium flows. Each of the refrigerant channels is adjacent to an associated one of the heating medium channels with one of the heat transfer plates interposed therebetween. The shell-and-plate heat exchanger further includes one or more supply structures that supply the refrigerant to the refrigerant channels such that the refrigerant flows downward.

9 Claims, 13 Drawing Sheets

(51) Int. Cl.
*F25B 39/02* (2006.01)
*F28D 9/00* (2006.01)

(52) U.S. Cl.
CPC ..... *F25B 2339/0241* (2013.01); *F28D 2021/0068* (2013.01)

(58) Field of Classification Search
CPC .... F28D 1/0325; F28D 5/02; F25B 2339/024; F25B 2339/0241; F25B 39/02
See application file for complete search history.

(56) References Cited

U.S. PATENT DOCUMENTS

| | | | | |
|---|---|---|---|---|
| 6,532,763 | B1 * | 3/2003 | Gupte | F28D 21/0017 62/515 |
| 9,072,985 | B2 * | 7/2015 | Andersen | B01D 1/22 |
| 2005/0039486 | A1 * | 2/2005 | Knoll | F28D 9/0043 62/515 |
| 2006/0191672 | A1 * | 8/2006 | Stenhede | F28F 3/04 165/145 |
| 2008/0041096 | A1 * | 2/2008 | Sakashita | F28D 21/0017 62/515 |
| 2008/0163637 | A1 * | 7/2008 | Ring | F28F 9/0265 62/304 |
| 2011/0120672 | A1 * | 5/2011 | Ringwaldt | F28D 3/00 165/104.14 |
| 2013/0319039 | A1 | 12/2013 | Sonninen et al. | |
| 2015/0292803 | A1 | 10/2015 | Nyander et al. | |
| 2016/0108762 | A1 * | 4/2016 | Mahmoud | F22B 27/165 60/671 |
| 2017/0153061 | A1 | 6/2017 | Yoshioka et al. | |

FOREIGN PATENT DOCUMENTS

| | | | |
|---|---|---|---|
| EP | 3301390 | A1 | 4/2018 |
| JP | S54-084648 | A | 7/1979 |
| JP | H02-109171 | U | 8/1990 |
| JP | H04-108174 | U | 9/1992 |
| JP | H07-503057 | A | 3/1995 |
| JP | 2006-527835 | A | 12/2006 |
| JP | 2012-57900 | A | 3/2012 |
| JP | 2016-14495 | A | 1/2016 |

OTHER PUBLICATIONS

International Search Report issued in corresponding International Application No. PCT/JP2021/001023 dated Mar. 3, 2021 (3 pages).
Decision to Grant a Patent issued in corresponding Japanese Application No. 2021-003928 dated Jun. 29, 2021 (5 pages).
Notice of Reasons for Refusal issued in corresponding Japanese Application No. 2021-003928 dated Feb. 24, 2021 (14 pages).
Extended European Search Report issued in corresponding European Patent Application No. 21741431.7, dated Dec. 15, 2022 (5 pages).

* cited by examiner

SIDE

SIDE

SHELL-AND-PLATE HEAT EXCHANGER

TECHNICAL FIELD

The present disclosure relates to a shell-and-plate heat exchanger.

BACKGROUND

A shell-and-plate heat exchanger as disclosed by Patent Document 1 has been known. This shell-and-plate heat exchanger includes a plate stack having a plurality of heat transfer plates and a shell housing the plate stack.

The heat exchanger of Patent Document 1 is a flooded evaporator. In this heat exchanger, the plate stack is immersed in a liquid refrigerant stored in the shell. The liquid refrigerant in the shell evaporates when the liquid refrigerant exchanges heat with a heating medium flowing through the plate stack, and flows out of the shell through a refrigerant outlet formed in the top of the shell.

PATENT LITERATURE

Patent Document 1: Japanese Unexamined Patent Publication No. 2006-527835

SUMMARY

One or more embodiments of the present disclosure are directed to a shell-and-plate heat exchanger (10) including: a shell (20) forming an internal space (21); and a plate stack (40) housed in the internal space (21) of the shell (20) and including a plurality of heat transfer plates (50*a*, 50*b*) stacked and joined together, the shell-and-plate heat exchanger allowing a refrigerant that has flowed into the internal space (21) of the shell (20) to evaporate. The plate stack (40) forms a plurality of refrigerant channels (41) that communicate with the internal space (21) of the shell (20) and allow a refrigerant to flow through and a plurality of heating medium channels (42) that are blocked from the internal space (21) of the shell (20) and allow a heating medium to flow through, each of the refrigerant channels (41) being adjacent to an associated one of the heating medium channels (42) with the heat transfer plate (50*a*, 50*b*) interposed therebetween, and the shell-and-plate heat exchanger includes a supply structure (70) configured to supply the refrigerant to the refrigerant channels (41) such that the refrigerant flows downward.

DETAILED DESCRIPTION

First Embodiments

First embodiments will be described. A shell-and-plate heat exchanger (10) (which will be hereinafter referred to as a "heat exchanger") of the embodiments is a falling film type evaporator. The heat exchanger (10) of the embodiments is provided in a refrigerant circuit of a refrigeration apparatus that performs a refrigeration cycle, and cools a heating medium with a refrigerant. Examples of the heating medium include water and brine.

Figure 1B:
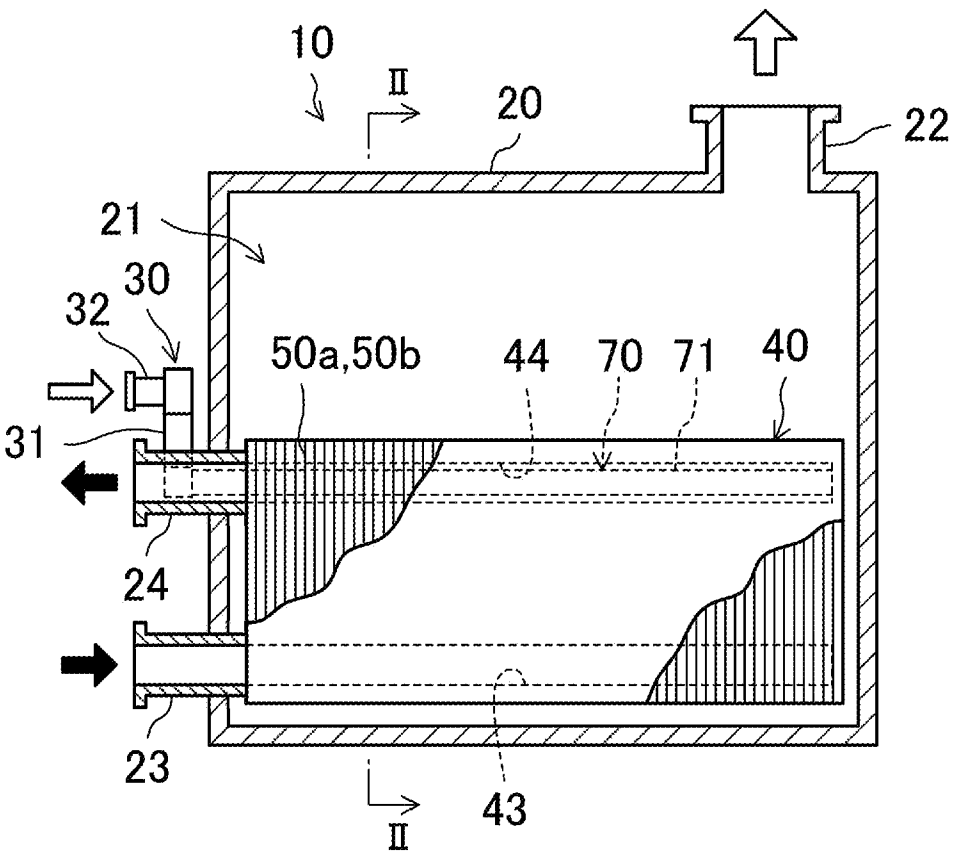
FIG. 1B is a cross-sectional view of the shell-and-plate heat exchanger taken along line I-I.
Figure 1A:
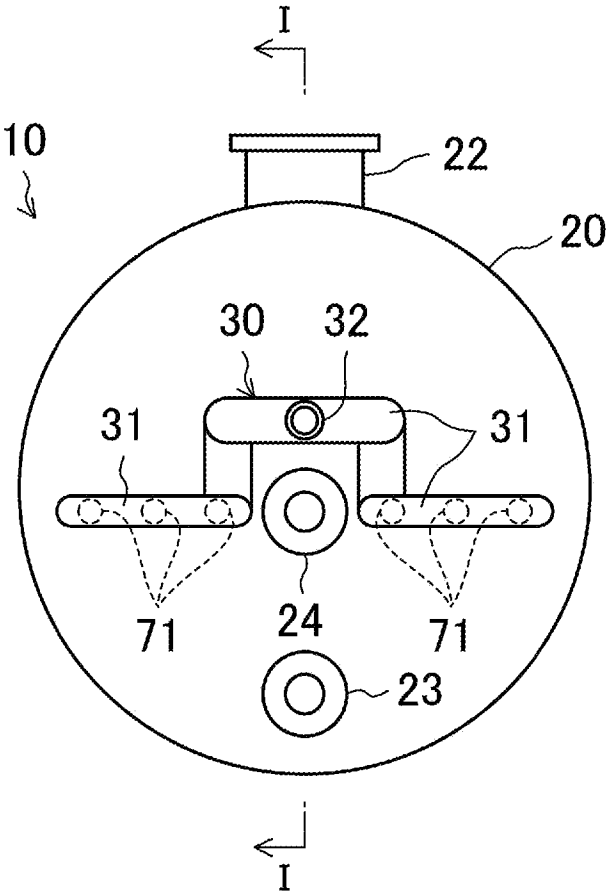
FIG. 1A is a side view of a shell-and-plate heat exchanger of first embodiments.

As illustrated in FIGS. 1A and 1B, the heat exchanger (10) of the embodiments includes a shell (20) and a plate stack (40). The plate stack (40) is housed in an internal space (21) of the shell (20). The heat exchanger (10) also includes a plurality of (in the embodiments, six) refrigerant introduction pipes (71) that constitute a supply structure (70), and one refrigerant distributor (30).

—Shell—

The shell (20) is in the shape of a cylinder with both ends closed. The shell (20) is arranged so that its longitudinal direction coincides with a lateral direction. A refrigerant outlet (22) for emitting the refrigerant out of the internal space (21) of the shell (20) is provided at the top of the shell (20). The refrigerant outlet (22) is disposed near the right end of the shell (20) in FIGS. 1A and 1B. The refrigerant outlet (22) is connected to a compressor of the refrigeration apparatus via a pipe.

The shell (20) is provided with a heating medium inlet (23) and a heating medium outlet (24). The heating medium inlet (23) and the heating medium outlet (24) are tubular members. Each of the heating medium inlet (23) and the heating medium outlet (24) passes through the left end of the shell (20) in FIGS. 1A and 1B and is connected to the plate stack (40). The heating medium inlet (23) is connected to a heating medium introduction path (43) of the plate stack (40) to supply the heating medium to the plate stack (40). The heating medium outlet (24) is connected to a heating medium emission path (44) of the plate stack (40) to emit the heating medium out of the plate stack (40).

—Plate Stack—

As illustrated in FIG. 1B, the plate stack (40) includes a plurality of heat transfer plates (50*a*, 50*b*) stacked together. The plate stack (40) is housed in the internal space (21) of the shell (20) so that the stacking direction of the heat transfer plates (50*a*, 50*b*) coincides with the lateral direction.

Figure 2:
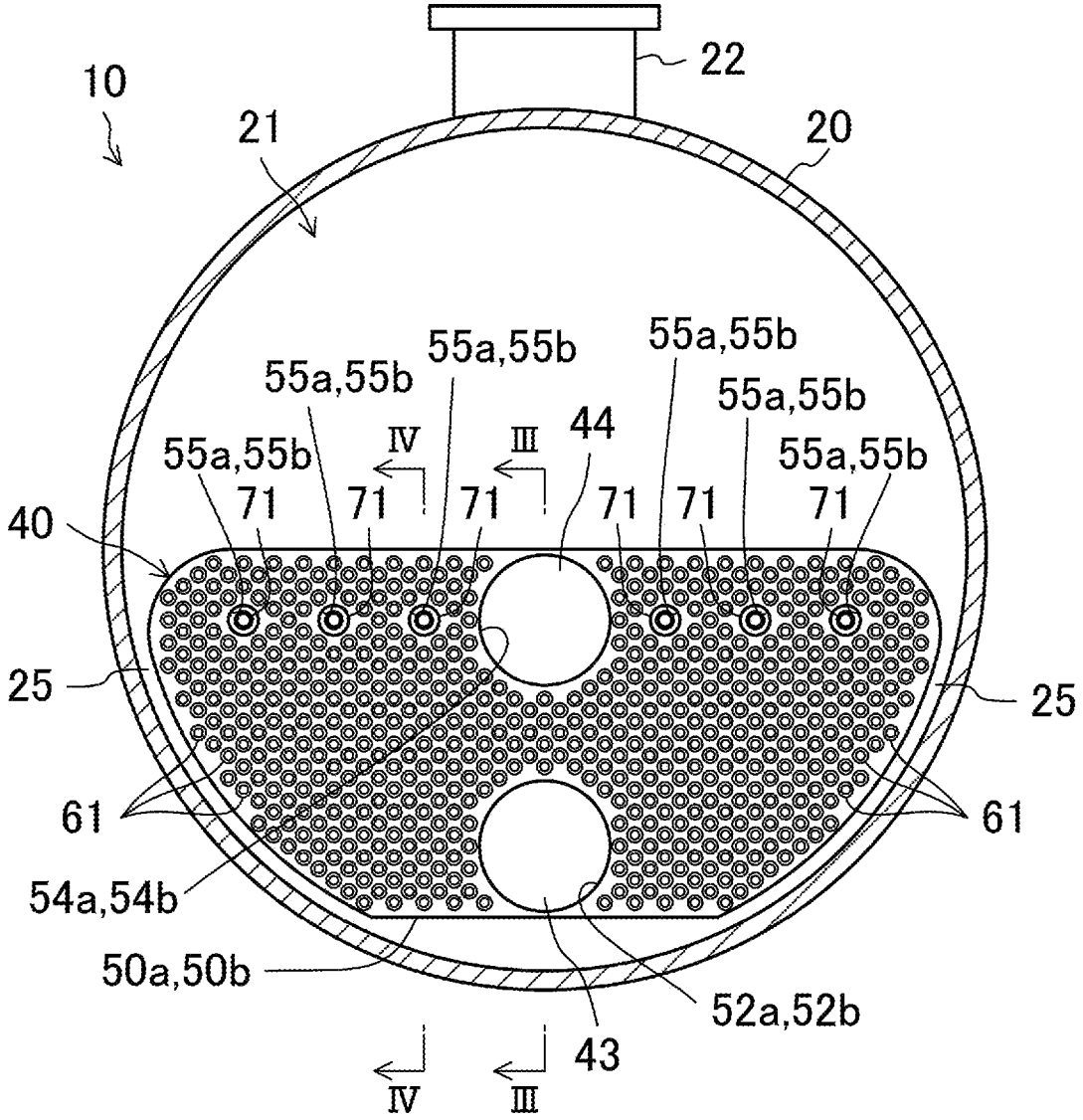
FIG. 2 is a cross-sectional view of the shell-and-plate heat exchanger of the first embodiments taken along line II-II in FIG. 1B.

As illustrated in FIG. 2, the heat transfer plates (50*a*, 50*b*) constituting the plate stack (40) are substantially semicircular plate-shaped members. The plate stack (40) is arranged near the bottom of the internal space (21) of the shell (20) with arc-shaped edges of the heat transfer plates (50*a*, 50*b*) facing downward.

Although not shown, supports in the shape of protrusions for supporting the plate stack (40) protrude from the interior surface of the shell (20). The plate stack (40) housed in the internal space (21) of the shell (20) is spaced apart from the inner surface of the shell (20), and forms a gap (25) between the downward-facing edges of the heat transfer plates (50*a*, 50*b*) of the plate stack (40) and the inner surface of the shell (20).

Figure 3:
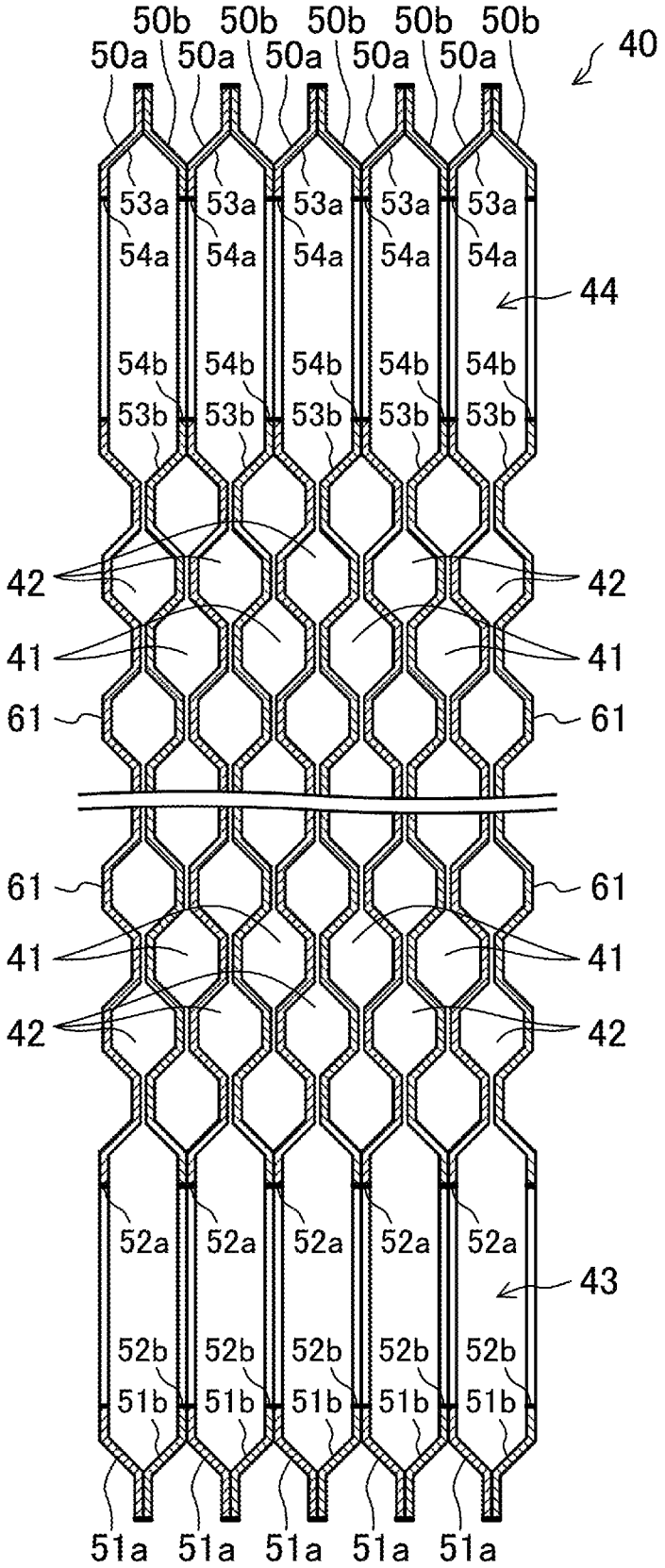
FIG. 3 is a cross-sectional view of a plate stack taken along line III-III in FIG. 2.

As illustrated in FIG. 3, the plate stack (40) includes first plates (50*a*) and second plates (50*b*) having different shapes as the heat transfer plates. The plate stack (40) includes a plurality of first plates (50*a*) and a plurality of second plates (50*b*). The first plates (50*a*) and the second plates (50*b*) are alternately stacked to form the plate stack (40). In the following description, for each of the first plates (50*a*) and the second plates (50*b*), a surface on the left in FIG. 3 will be referred to as a front surface, and a surface on the right in FIG. 3 will be referred to as a back surface.

<Refrigerant Channel and Heating Medium Channel>

As illustrated in FIG. 3, the plate stack (40) includes the refrigerant channels (41) and the heating medium channels (42), with the heat transfer plate (50*a*, 50*b*) interposed therebetween. The heat transfer plate (50*a*, 50*b*) separates the refrigerant channel (41) from the corresponding heating medium channel (42).

Each of the refrigerant channels (41) is a channel sandwiched between the front surface of the first plate (50*a*) and the back surface of the second plate (50*b*). The refrigerant channel (41) communicates with the internal space (21) of the shell (20). Each of the heating medium channels (42) is a channel sandwiched between the back surface of the first plate (50*a*) and the front surface of the second plate (50*b*). The heating medium channel (42) is blocked from the internal space (21) of the shell (20), and communicates with the heating medium inlet (23) and the heating medium outlet (24) attached to the shell (20).

<Dimples>

As illustrated in FIGS. 2 and 3, each of the first plates (50*a*) and the second plates (50*b*) has multiple dimples (61). The dimples (61) of the first plate (50*a*) bulge toward the front side of the first plate (50*a*). The dimples (61) of the second plate (50*b*) bulge toward the back side of the second plate (50*b*).

<Heating Medium Introduction Path and Heating Medium Emission Path>

Each of the first plates (50*a*) has an inlet protrusion (51*a*) and an outlet protrusion (53*a*). Each of the inlet protrusion (51*a*) and the outlet protrusion (53*a*) is a circular portion bulging toward the front side of the first plate (50*a*). Each of the inlet protrusion (51*a*) and the outlet protrusion (53*a*) is formed in a widthwise center portion of the first plate (50*a*). The inlet protrusion (51*a*) is formed in a lower portion of the first plate (50*a*). The outlet protrusion (53*a*) is formed in an upper portion of the first plate (50*a*). A first inlet hole (52*a*) is formed in a center portion of the inlet protrusion (51*a*). A first outlet hole (54*a*) is formed in a center portion of the outlet protrusion (53*a*). Each of the first inlet hole (52*a*) and the first outlet hole (54*a*) is a circular hole penetrating the first plate (50*a*) in a thickness direction.

Each of the second plates (50*b*) has an inlet recess (51*b*) and an outlet recess (53*b*). Each of the inlet recess (51*b*) and the outlet recess (53*b*) is a circular portion bulging toward the back side of the second plate (50*b*). Each of the inlet recess (51*b*) and the outlet recess (53*b*) is formed in a widthwise center portion of the second plate (50*b*). The inlet recess (51*b*) is formed in a lower portion of the second plate (50*b*). The outlet recess (53*b*) is formed in an upper portion of the second plate (50*b*). A second inlet hole (52*b*) is formed in a center portion of the inlet recess (51*b*). A second outlet hole (54*b*) is formed in a center portion of the outlet recess (53*b*). Each of the second inlet hole (52*b*) and the second outlet hole (54*b*) is a circular hole penetrating the second plate (50*b*) in a thickness direction.

In the second plate (50*b*), the inlet recess (51*b*) is formed at a position corresponding to the inlet protrusion (51*a*) of the first plate (50*a*), and the outlet recess (53*b*) is formed at a position corresponding to the outlet protrusion (53*a*) of the first plate (50*a*). In the second plate (50*b*), the second inlet hole (52*b*) is formed at a position corresponding to the first inlet hole (52*a*) of the first plate (50*a*), and the second outlet hole (54*b*) is formed at a position corresponding to the first outlet hole (54*a*) of the first plate (50*a*). The first inlet hole (52*a*) and the second inlet hole (52*b*) have a substantially equal diameter. The first outlet hole (54*a*) and the second outlet hole (54*b*) have a substantially equal diameter.

In the plate stack (40), each first plate (50*a*) and an adjacent one of the second plates (50*b*) on the back side of the first plate (50*a*) are welded together at their peripheral portions along the whole perimeter. In the plate stack (40), the first inlet hole (52*a*) of each first plate (50*a*) overlaps the second inlet hole (52*b*) of an adjacent one of the second plates (50*b*) on the front side of the first plate (50*a*), and the rims of the overlapping first inlet hole (52*a*) and second inlet hole (52*b*) are welded together along the entire perimeter. In the plate stack (40), the first outlet hole (54*a*) of each first plate (50*a*) overlaps the second outlet hole (54*b*) of an adjacent one of the second plates (50*b*) on the front side of the first plate (50*a*), and the rims of the overlapping first outlet hole (54*a*) and second outlet hole (54*b*) are welded together along the whole perimeter.

In the plate stack (40), the inlet protrusions (51*a*) and first inlet holes (52*a*) of the first plates (50*a*) and the inlet recesses (51*b*) and second inlet holes (52*b*) of the second plates (50*b*) form the heating medium introduction path (43). In the plate stack (40), the outlet protrusions (53*a*) and first outlet holes (54*a*) of the first plates (50*a*) and the outlet recesses (53*b*) and second outlet holes (54*b*) of the second plates (50*b*) form the heating medium emission path (44).

The heating medium introduction path (43) and the heating medium emission path (44) are passages extending in the stacking direction of the heat transfer plates (50*a*, 50*b*) in the plate stack (40). The heating medium introduction path (43) is a passage blocked from the internal space (21) of the shell (20), and allows all the heating medium channels (42) to communicate with the heating medium inlet (23). The heating medium emission path (44) is a passage blocked from the internal space (21) of the shell (20), and allows all the heating medium channels (42) to communicate with the heating medium outlet (24).

<First Circular Hole and Second Circular Hole>

Figure 4:
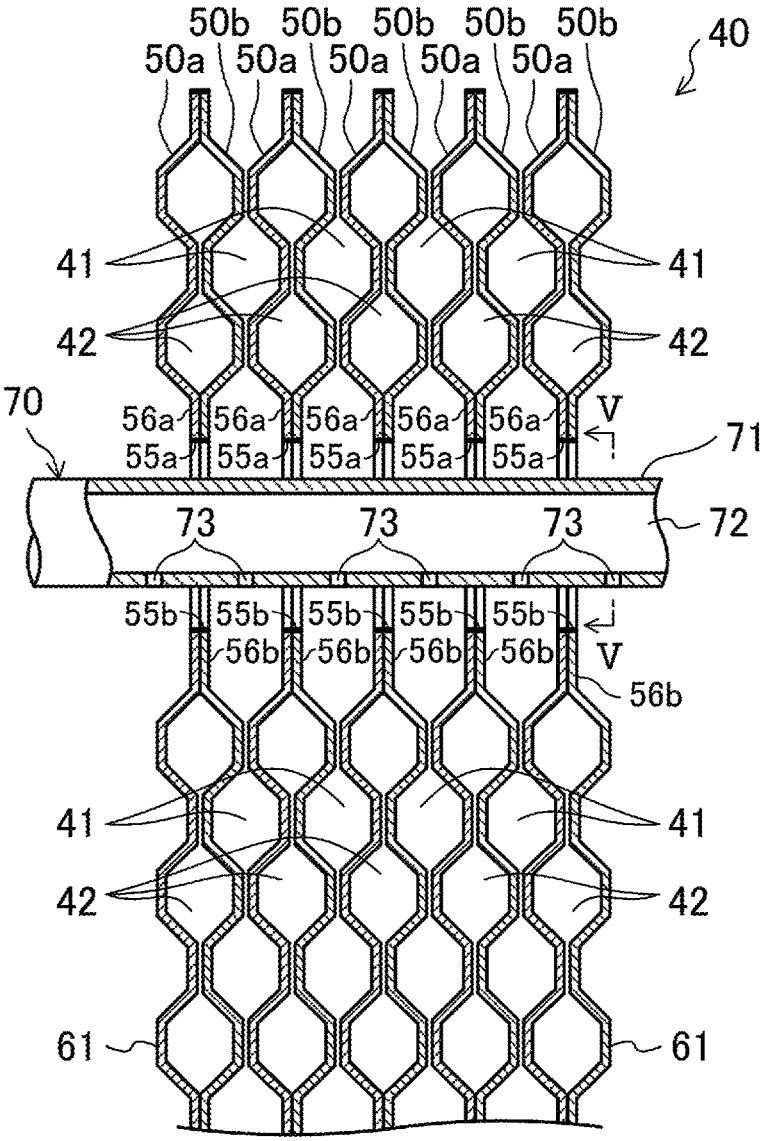
FIG. 4 is a cross-sectional view of the plate stack taken along line IV-IV in FIG. 2.

As illustrated in FIGS. 2 and 4, each of the first plates (50*a*) has a plurality of (in the embodiments, six) first circular holes (55*a*). The first circular hole (55*a*) is a circular hole penetrating the first plate (50*a*) in a thickness direction. The first plate (50*a*) has the same number of first flat portions (56*a*) as the number of first circular holes (55*a*). Each of the first flat portions (56*a*) is a flat portion surrounding the periphery of an associated one of the first circular holes (55*a*).

As illustrated in FIG. 2, the plurality of first circular holes (55*a*) are arranged in a row along the upper edge of the first plate (50*a*) in the width direction of the first plate (50*a*) (the lateral direction in FIG. 2). The plurality of first circular hole (55*a*) are arranged at predetermined intervals. In the first plate (50*a*), the same number of (in the embodiments, three) first circular holes (55*a*) are formed in each of left and right side regions of the first outlet hole (54*a*) in FIG. 2. The distance from the top of each of the first circular holes (55*a*) to the upper edge of the first plate (50*a*) is longer than the distance from the top of the first outlet hole (54*a*) to the upper edge of the first plate (50*a*).

As illustrated in FIGS. 2 and 4, each of the second plates (50*b*) has a plurality of (in the embodiments, six) second circular holes (55*b*). The second circular hole (55*b*) is a circular hole penetrating the second plate (50*b*) in the thickness direction. The second plate (50*b*) has the same number of second flat portions (56*b*) as the number of second circular hole (55*b*). Each of the second flat portions (56*b*) is a flat portion surrounding the periphery of an associated one of the second circular holes (55*b*).

As illustrated in FIG. 2, the plurality of second circular holes (55*b*) are arranged in a row along the upper edge of the second plate (50*b*) in the width direction of the second plate (50*b*) (the lateral direction in FIG. 2). The plurality of second circular holes (55*b*) are arranged at predetermined intervals. In the second plate (50*b*), the same number of (in the embodiments, three) second circular holes (55*b*) are formed in each of left and right side regions of the second outlet hole (54*b*) in FIG. 2. The distance from the top of each of the second circular holes (55*b*) to the upper edge of the second plate (50*b*) is longer than the distance from the top of the second outlet hole (54*b*) to the upper edge of the second plate (50*b*).

In the second plate (50*b*), the second circular hole (55*b*) is formed at a position corresponding to the first circular hole (55*a*) of the first plate (50*a*). The first circular hole (55*a*) and the second circular hole (55*b*) have a substantially equal diameter. In the plate stack (40), the first circular hole (55*a*) of each first plate (50*a*) overlaps the second circular hole (55*b*) of an adjacent one of the second plates (50*b*) on the back side of the first plate (50*a*), and the rims of the overlapping first circular hole (55*a*) and second circular hole (55*b*) are welded together along the whole perimeter.

—Supply Structure—

In the heat exchanger (10) of the present embodiments, six refrigerant introduction pipes (71) constitute the supply structure (70) for supplying a refrigerant to the refrigerant channels (41) of the plate stack (40).

As illustrated in FIGS. 1A, 1B, and 4, each of the refrigerant introduction pipes (71) is a circular pipe member. The internal space of the refrigerant introduction pipe (71) is a refrigerant introduction channel (72). As illustrated in FIG. 1B, the refrigerant introduction pipe (71) passes through the plate stack (40) in a stacking direction of the heat transfer plates (50*a*, 50*b*). The distal end of the refrigerant introduction pipe (71) is closed. The base end of the refrigerant introduction pipe (71) passes through the left end of the shell (20) in FIG. 1B and is exposed to the outside of the shell (20).

As illustrated in FIGS. 2 and 4, the refrigerant introduction pipe (71) is inserted in, and passes through, the first circular hole (55*a*) and the second circular hole (55*b*) of the overlapping first plate (50*a*) and second plate (50*b*). Each of the refrigerant introduction pipes (71) passes through the corresponding first circular hole (55*a*) and second circular hole (55*b*). In the plate stack (40) of the embodiments, the six refrigerant introduction pipes (71) are arranged such that their axial directions are substantially horizontal and substantially parallel to each other. The six refrigerant introduction pipes (71) are arranged in a row at predetermined intervals in the width direction of the heat transfer plate (50*a*, 50*b*).

As illustrated in FIG. 4, the refrigerant introduction pipe (71) has a plurality of (in the embodiments, three) supply holes (73) at each of portions where the refrigerant introduction pipe (71) crosses the refrigerant channels (41) of the plate stack (40). The supply holes (73) penetrate the refrigerant introduction pipe (71) in the radial direction to be open on inner and outer surfaces of the refrigerant introduction pipe (71). The supply holes (73) allow the refrigerant introduction channel (72), which is an interior of the refrigerant introduction pipe (71), to communicate with the refrigerant channels (41) on the outside of the refrigerant introduction pipe (71).

Figure 5:
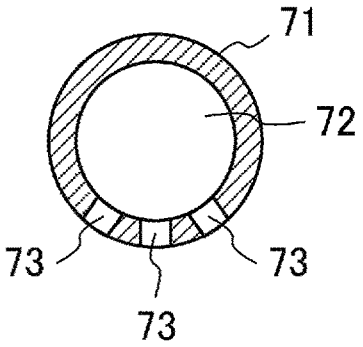
FIG. 5 is a cross-sectional view of a refrigerant introduction pipe taken along line V-V in FIG. 4.

As illustrated in FIG. 5, the three supply holes (73) are formed downward at each of the portions of the refrigerant introduction pipe (71) crossing the refrigerant channels (41). The refrigerant introduction pipe (71) of the embodiments includes the supply hole (73) opening directly downward, the supply hole (73) opening diagonally down to the right, and the supply hole (73) opening diagonally down to the left at each of the portions crossing the refrigerant channels (41).

—Refrigerant Distributor—

The refrigerant distributor (30) is a member for distributing the refrigerant to be supplied to the heat exchanger (10) to all of the refrigerant introduction pipes (71).

As illustrated in FIGS. 1A and 1B, the refrigerant distributor (30) has a distributor body (31) and a refrigerant inlet (32), and is disposed outside the shell (20). The distributor body (31) is a hollow member, and is connected to the base end of each refrigerant introduction pipe (71) exposed to the outside of the shell (20). The refrigerant inlet (32) is a short circular pipe member, and is connected to the distributor body (31). The distributor body (31) distributes the refrigerant that has flowed in from the refrigerant inlet (32) to all of the refrigerant introduction pipes (71).

—Flows of Refrigerant and Heating Medium in Heat Exchanger—

Flows of the refrigerant and the heating medium in the heat exchanger (10) of the embodiments will be described below.

<Flow of Refrigerant>

The heat exchanger (10) receives a low-pressure refrigerant in a gas-liquid two-phase state that has passed through the expansion mechanism of the refrigerant circuit. The refrigerant to be supplied to the heat exchanger (10) flows into the distributor body (31) of the refrigerant distributor (30) from the refrigerant inlet (32), and is distributed to a plurality of (in the embodiments, six) refrigerant introduction pipes (71).

Figure 6:
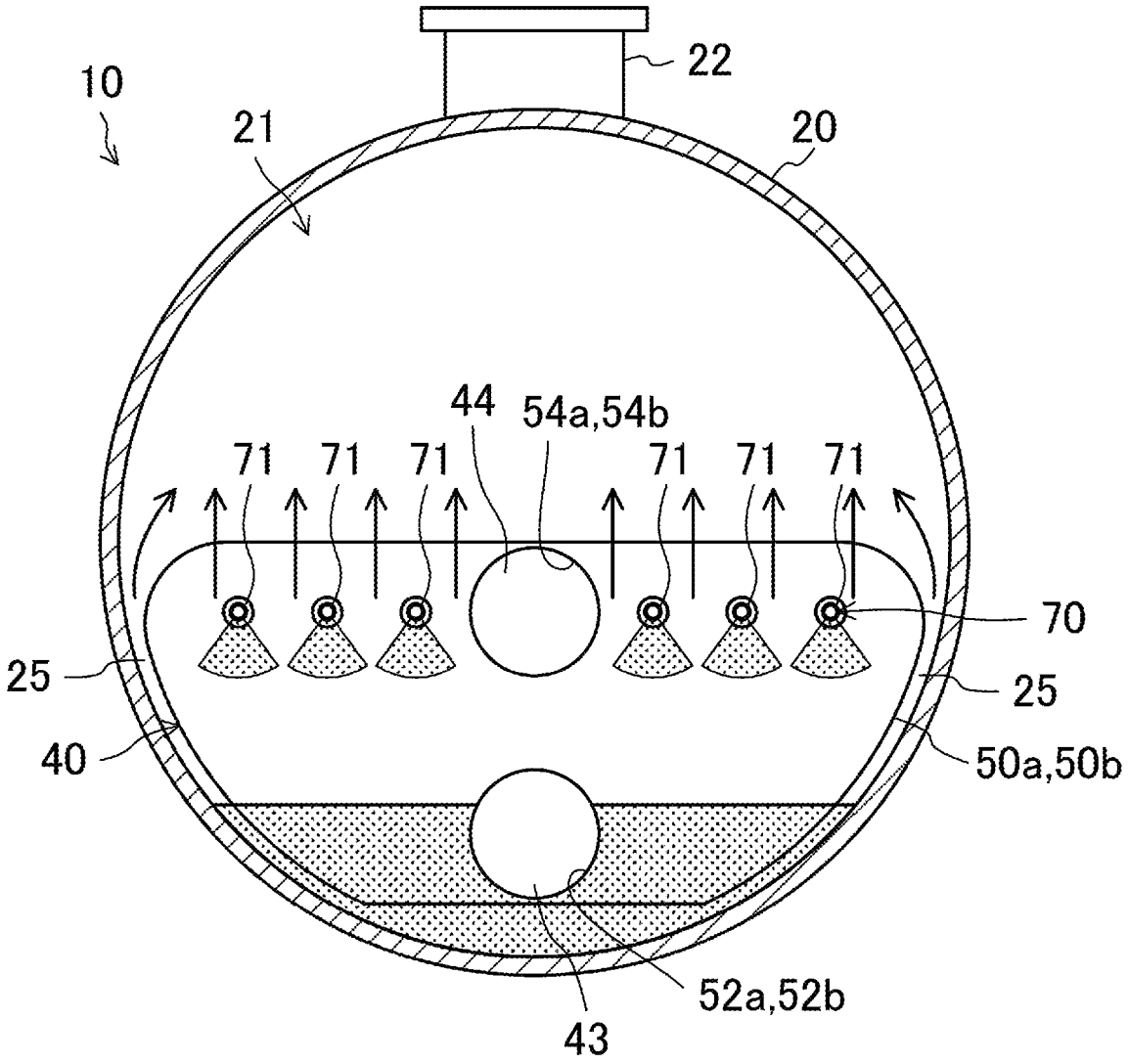
FIG. 6 is a cross-sectional view corresponding to FIG. 2, illustrating a refrigerant flow in the shell-and-plate heat exchanger.

The refrigerant that has flowed into the refrigerant introduction channel (72) of each refrigerant introduction pipe (71) is supplied to the corresponding refrigerant channels (41) of the plate stack (40) through the supply holes (73). At this moment, the refrigerant is dispersed to the front surface of the first plate (50*a*) and the back surface of the second plate (50*b*) which define the refrigerant channel (41). Further, as illustrated in FIG. 6, the refrigerant is dispersed downward in a circular sector from the three supply holes (73) for the respective refrigerant channels (41). In FIG. 6, dimples (61) of the heat transfer plates (50*a*, 50*b*) are omitted.

The refrigerant supplied to the refrigerant channels (41) flows down along the front surface of the first plate (50*a*) or the back surface of the second plate (50*b*), and while flowing down, absorbs heat from the heating medium flowing through the heating medium channels (42) and evaporates. The heat transfer plate (50*a*, 50*b*) of the embodiments has a lot of dimples (61). The liquid refrigerant flowing down along the heat transfer plate (50*a*, 50*b*) hits the dimples (61) and diffuses in the lateral direction. This means that a region of the front surface or the back surface of the heat transfer plate (50*a*, 50*b*) that comes into contact with the liquid refrigerant is enlarged, and that the liquid refrigerant stays on the front surface or the back surface of the heat transfer plate (50*a*, 50*b*) for a longer time.

As illustrated in FIG. 6, the liquid refrigerant that has not evaporated while flowing down along the heat transfer plate (50*a*, 50*b*) accumulates at the bottom of the internal space (21) of the shell (20). That is, a lower portion of the plate stack (40) is immersed in the liquid refrigerant. In the portion of the plate stack (40) immersed in the liquid refrigerant, the liquid refrigerant filling the refrigerant channels (41) is heated by the heating medium in the heating medium channels (42) and evaporates.

As indicated by the arrows in FIG. 6, the gas refrigerant generated in the refrigerant channels (41) flows upward in the refrigerant channels (41), passes between the refrigerant introduction pipes (71) arranged next to each other in the width direction of the heat transfer plate (50*a*, 50*b*), and flows into the space above the plate stack (40). Part of the gas refrigerant generated in the refrigerant channels (41) flows laterally into the gap (25) between the plate stack (40) and the shell (20), and flows into the space above the plate stack (40) through the gap (25).

The refrigerant flowing into the space above the plate stack (40) contains a liquid refrigerant in the form of fine drops. On the other hand, the flow velocity of the refrigerant flowing through the space above the plate stack (40) is low because this space above the plate stack (40) is a relatively large space. Thus, most of the liquid refrigerant in the form of droplets in the refrigerant falls downward by gravity. The refrigerant that has flowed into the space above the plate stack (40) flows out of the shell (20) through the refrigerant outlet (22). The refrigerant flowed out of the shell (20) is sucked into the compressor of the refrigeration apparatus.

<Flow of Heating Medium>

The heating medium to be supplied to the heat exchanger (10) flows into the heating medium introduction path (43) of the plate stack (40) through the heating medium inlet (23), and is distributed to the heating medium channels (42). The heating medium that has flowed into each heating medium channel (42) flows generally upward while spreading in the width direction of the heat transfer plates (50*a*, 50*b*). The heating medium flowing in the heating medium channels (42) dissipates heat to the refrigerant flowing in the refrigerant channels (41). This lowers the temperature of the heating medium.

The heating medium cooled while flowing through each heating medium channel (42) flows into the heating medium emission path (44), and merges with the flows of the heating medium that have passed through the other heating medium channels (42). Thereafter, the heating medium in heating medium emission path (44) flows out of the heat exchanger (10) through the heating medium outlet (24), and is used for purposes such as air conditioning.

—Feature (1) of First Embodiments—

The shell-and-plate heat exchanger (10) of the embodiments has the supply structure (70) for supplying the refrigerant to the refrigerant channels (41). The refrigerant supplied to the refrigerant channels (41) exchanges heat with the heating medium flowing through the heating medium channels (42) and evaporates, while flowing down along the heat transfer plates (50*a*, 50*b*). The shell-and-plate heat exchanger (10) of the embodiments functions as a falling film type evaporator.

—Feature (2) of First Embodiments—

Suppose that in a shell-and-plate heat exchanger used as a falling film type evaporator, the supply structure (70) for supplying refrigerant to the plate stack (40) is disposed above the plate stack (40) in the shell (20). Placing the supply structure (70) above the plate stack (40) may narrow the space above the plate stack (40) in the shell (20) and increase the flow velocity of the refrigerant in the space above the plate stack (40).

A gas refrigerant flowing upward from the plate stack (40) contains a liquid refrigerant in the form of droplets. As the flow velocity of the refrigerant in the space above the plate stack (40) increases, more droplets flow with the gas refrigerant without falling due to gravity. This increases the amount of liquid refrigerant flowing out of the shell (20) together with the gas refrigerant, impairing the performance of the heat exchanger (10).

On the other hand, in the heat exchanger (10) of the embodiments, the supply structure (70) is located inside the outer peripheries of the heat transfer plates (50*a*, 50*b*) in the plate stack (40). This configuration ensures the space above the plate stack (40) in the shell (20) and keeps the flow velocity of the refrigerant in the space above the plate stack (40) low. As a result, the amount of liquid refrigerant flowing out of the shell (20) together with the gas refrigerant is kept small, improving the performance of the heat exchanger (10).

—Feature (3) of First Embodiments—

The supply structure (70) of the embodiments includes the refrigerant introduction channel (72) and the supply holes (73). The refrigerant introduction channel (72) passes through the heat transfer plate (50*a*, 50*b*) of the plate stack (40). The supply holes (73) allow the refrigerant introduction channel (72) to communicate with the refrigerant channels (41) so that the refrigerant is supplied to the refrigerant channel (41).

In the supply structure (70) of the embodiments, the refrigerant flowing through the refrigerant introduction channel (72) is supplied to the refrigerant channels (41) of the plate stack (40) through the supply holes (73).

—Feature (4) of First Embodiments—

In the supply structure (70) of the embodiments, a plurality of supply holes (73) are provided for each of a plurality of refrigerant channels (41) formed in the plate stack (40).

In the heat exchanger (10) of the embodiments, the refrigerant is supplied from the plurality of supply holes (73) to the corresponding one of the plurality of refrigerant channels (41) formed in the plate stack (40). Thus, the liquid refrigerant can be supplied to a wide area of the front surface or the back surface of the heat transfer plate (50*a*, 50*b*), making it possible to promote heat exchange between the refrigerant and the heating medium.

—Feature (5) of First Embodiments—

In the supply structure (70) of the embodiments, the refrigerant introduction channel (72) is formed by the refrigerant introduction pipe (71). The refrigerant introduction pipe (71) passes through a plurality of heat transfer plates (50*a*, 50*b*) of the plate stack (40). The supply holes (73) penetrate the refrigerant introduction pipe (71) to be open on inner and outer surfaces of the refrigerant introduction pipe (71).

In the supply structure (70) of the embodiments, the supply holes (73) are formed in the refrigerant introduction pipe (71) forming the refrigerant introduction channel (72). The supply holes (73) penetrate the refrigerant introduction pipe (71) and allow the refrigerant introduction channel (72) to communicate with the refrigerant channels (41).

—Feature (6) of First Embodiments—

The heat exchanger (10) of the embodiments includes a plurality of supply structures (70). The plurality of supply structures (70) are arranged at predetermined intervals along upward-facing edges of the heat transfer plates (50*a*, 50*b*) of the plate stack (40).

The heat exchanger (10) of the embodiments includes a plurality of supply structures (70). The plurality of supply structures (70) are arranged at predetermined intervals. The refrigerant that has exchanged heat with the heating medium and evaporated in the plate stack (40) passes between the plurality of supply structures (70) and flows into the space above the plate stack (40).

—Feature (7) of First Embodiments—

The plate stack (40) of the embodiments includes the heating medium introduction path (43) and the heating medium emission path (44). Each of the heating medium introduction path (43) and the heating medium emission path (44) penetrates the heat transfer plates (50*a*, 50*b*) and communicates with the heating medium channels (42). Each of the heating medium introduction path (43) and the heating medium emission path (44) is formed at a widthwise center portion of the heat transfer plates (50*a*, 50*b*). The same number of supply structures (70) are provided in each of left and right side regions of the heating medium introduction path (43) and the heating medium emission path (44) in the width direction of the heat transfer plates (50*a*, 50*b*).

The plate stack (40) of the embodiments includes the heating medium introduction path (43) and the heating medium emission path (44) at a widthwise center portion of the heat transfer plates (50*a*, 50*b*). In this plate stack (40), the same number of supply structures (70) are provided in each of left and right side regions of the heating medium introduction path (43) and the heating medium emission path (44) in the width direction of the heat transfer plates (50*a*, 50*b*). Thus, the liquid refrigerant can be supplied from the supply structures (70) to a wide region of the surfaces of the heat transfer plates (50*a*, 50*b*).

—Feature (8) of First Embodiments—

The heat exchanger (10) of the embodiments includes the refrigerant distributor (30) configured to distribute the refrigerant to the plurality of supply structures (70).

The refrigerant to be supplied to the heat exchanger (10) of the embodiments is distributed to the plurality of supply structures (70) by the refrigerant distributor (30), and is supplied to the refrigerant channels (41) of the plate stack (40) from the respective supply structures (70).

—Feature (9) of First Embodiments—

The heat exchanger (10) of the embodiments is configured such that the liquid refrigerant accumulates at the bottom of the internal space (21) of the shell (20). The plate stack (40) is provided at a position where a lower portion of the plate stack (40) is immersed in the liquid refrigerant accumulated at the bottom of the internal space (21).

In the heat exchanger (10) of the embodiments, a lower portion of the plate stack (40) is immersed in the liquid refrigerant accumulated at the bottom of the internal space (21). In the internal space (21) of the shell (20), the refrigerant supplied to the refrigerant channels (41) of the plate stack (40) from the supply structures (70) and the refrigerant accumulated at the bottom of the internal space (21) exchange heat with the heating medium in the heating medium channels (42) and evaporate.

—Feature (10) of First Embodiments—

The plate stack (40) of the embodiments is positioned so as to leave a gap (25) between the downward-facing edges of the heat transfer plates (50*a*, 50*b*) and the interior surface of the shell (20).

In the heat exchanger (10) of the embodiments, part of the refrigerant evaporated in the plate stack (40) flows upward through the refrigerant channels (41), while the rest of the refrigerant flows out of the refrigerant channels (41) into the gap (25) between the plate stack (40) and the shell (20) and flows upward through the gap (25). This facilitates the discharge of the gas refrigerant from the refrigerant channels (41) of the plate stack (40).

Second Embodiments

Second embodiments will be described. The heat exchanger (10) of the embodiments is a heat exchanger (10) of the first embodiments with a modified supply structure (70). Thus, the following description will be focused on the differences between the heat exchanger (10) of the embodiments and the heat exchanger (10) of the first embodiments.

—Supply Structure—

Figure 7:
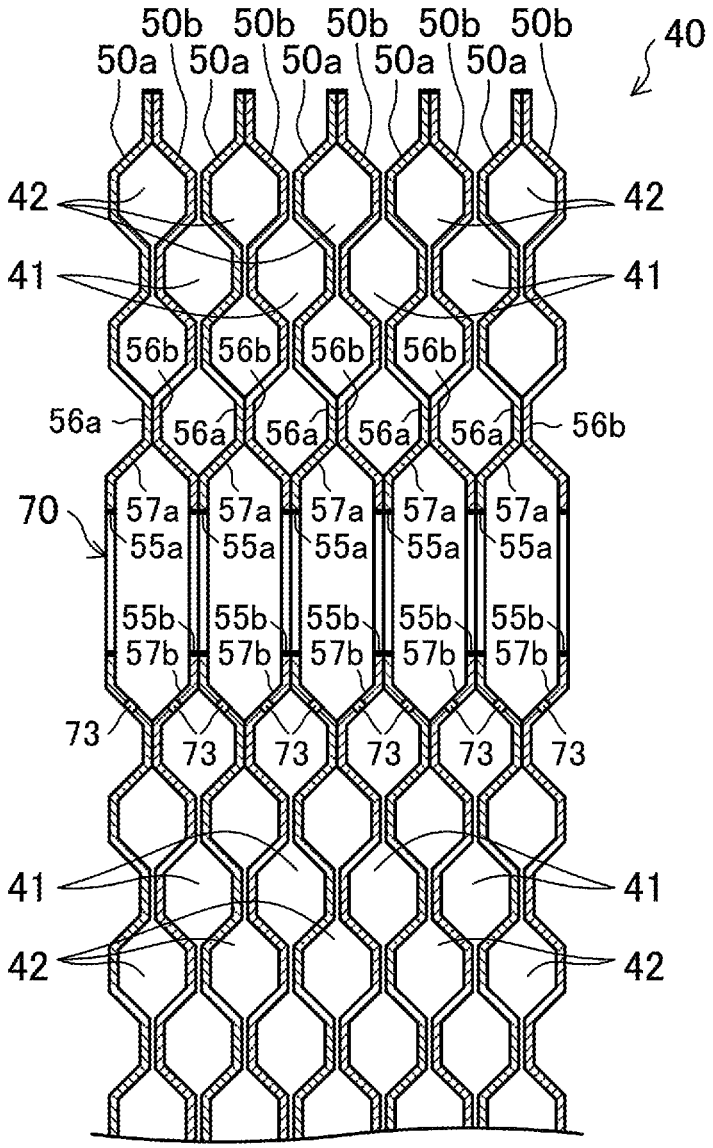
FIG. 7 is a cross-sectional view of a plate stack of second embodiments, which is a cross section corresponding to FIG. 3.

As illustrated in FIG. 7, the refrigerant introduction pipes (71) are omitted from the supply structure (70) of the embodiments, and the refrigerant introduction channel (72) is formed by the heat transfer plates (50*a*, 50*b*) of the plate stack (40). In the supply structure (70) of the embodiments, supply holes (73) are formed in the heat transfer plates (50*a*, 50*b*) of the plate stack (40).

<Refrigerant Introduction Channel>

Each of the first plates (50*a*) of the embodiments has a plurality of (in the embodiments, six) circular protrusions (57*a*). Each of the circular protrusions (57*a*) is a circular portion bulging toward the front side of the first plate (50*a*). The first plate (50*a*) of the embodiments includes a first flat portion (56*a*) surrounding the periphery of an associated one of the circular protrusions (57*a*). In the first plate (50*a*) of the embodiments, each of the circular protrusions (57*a*) has a first circular hole (55*a*). The position of the first circular hole (55*a*) in the first plate (50*a*) of the embodiments is substantially the same as the position of the first circular hole (55*a*) in the first plate (50*a*) of the first embodiments.

Each of the second plates (50*b*) of the embodiments has a plurality of (in the embodiments, six) circular recesses (57*b*). Each of the circular recesses (57*b*) is a circular portion bulging toward the back side of the second plate (50*b*). The second plate (50*b*) of the embodiments includes a second flat portion (56*b*) surrounding the periphery of an associated one of the circular recesses (57*b*). In the second plate (50*b*) of the embodiments, each of the circular recess (57*b*) has a second circular hole (55*b*). The position of the second circular hole (55*b*) in the second plate (50*b*) of the embodiments is substantially the same as the position of the second circular hole (55*b*) in the second plate (50*b*) of the first embodiments.

Similar to the plate stack (40) of the first embodiments, the first circular hole (55*a*) and the second circular hole (55*b*) have a substantially equal diameter. In the plate stack (40) of the embodiments, the first circular hole (55*a*) of each first plate (50*a*) overlaps the second circular hole (55*b*) of an adjacent one of the second plates (50*b*) on the front side of the first plate (50*a*), and the rims of the overlapping first circular hole (55*a*) and second circular hole (55*b*) are welded together along the whole perimeter.

In the plate stack (40) of the embodiments, the first flat portion (56*a*) of each first plate (50*a*) is in contact with the second flat portion (56*b*) of the second plate (50*b*) on the back side of the first plate (50*a*). The first flat portion (56*a*) and the second flat portion (56*b*) that are in contact with each other are joined by brazing. The first flat portion (56*a*) and the second flat portion (56*b*) that are in contact with each other may be joined by welding.

In the plate stack (40) of the embodiments, the circular protrusions (57*a*) and first inlet holes (52*a*) of the first plates (50*a*) and the circular recesses (57*b*) and second inlet holes (52*b*) of the second plates (50*b*) form the refrigerant introduction channels (72). Each of the refrigerant introduction channels (72) is a passage extending in the stacking direction of the heat transfer plates (50*a*, 50*b*) in the plate stack (40). Each of the refrigerant introduction channels (72) is a passage blocked from the heating medium channels (42) of the plate stack (40) and the internal space (21) of the shell (20). The plurality of (in the embodiments, six) refrigerant introduction channels (72) in the plate stack (40) are connected to the distributor body (31) of the refrigerant distributor (30) via a pipe or the like.

<Supply Hole>

As illustrated in FIG. 7, the supply holes (73) of the embodiments are formed in the heat transfer plates (50*a*, 50*b*).

Specifically, each first plate (50*a*) has the supply hole (73) at a lower part of an inclined portion of the circular protrusion (57*a*). The supply hole (73) penetrates the first plate (50*a*) in the thickness direction. The supply hole (73) is open to the front and back surfaces of the first plate (50*a*) and allows the refrigerant channel (41) defined by the front surface of the first plate (50*a*) to communicate with the refrigerant introduction channel (72).

Further, each second plate (50*b*) has the supply hole (73) at a lower part of an inclined portion of the circular recess (57*b*). The supply hole (73) penetrates the second plate (50*b*) in the thickness direction. The supply hole (73) is open to the front and back surfaces of the second plate (50*b*) and allows the refrigerant channel (41) defined by the back surface of the second plate (50*b*) to communicate with the refrigerant introduction channel (72).

—Flows of Refrigerant in Heat Exchanger—

The refrigerant to be supplied to the heat exchanger (10) flows into the distributor body (31) of the refrigerant distributor (30) from the refrigerant inlet (32), and is distributed to a plurality of (in the embodiments, six) refrigerant introduction channels (72). The refrigerant that has flowed into the refrigerant introduction channels (72) is supplied to the corresponding refrigerant channels (41) of the plate stack (40) through the supply holes (73). At this moment, the refrigerant is dispersed to the front surface of the first plate (50*a*) and the back surface of the second plate (50*b*) which define the refrigerant channel (41).

—Features of Second Embodiments—

In the supply structure (70) of the embodiments, the refrigerant introduction channel (72) is formed by the plurality of heat transfer plates (50*a*, 50*b*) of the plate stack (40) joined together. In this supply structure (70), the supply holes (73) penetrate the heat transfer plates (50*a*, 50*b*) and open on the front and back surfaces of the heat transfer plates (50*a*, 50*b*).

In the supply structure (70) of the embodiments, the refrigerant introduction channel (72) is formed by the plurality of heat transfer plates (50*a*, 50*b*) joined together. The supply holes (73) penetrate the heat transfer plates (50*a*, 50*b*) and allow the refrigerant introduction channel (72) to communicate with the refrigerant channels (41). Thus, according to the embodiments, the heat exchanger (10) can have the supply structure (70) without using an additional member in the heat exchanger (10).

Third Embodiments

The third embodiments will be described. The heat exchanger (10) of the embodiments is a heat exchanger (10) of the first embodiments with modified configurations of the plate stack (40) and the supply structure (70). Thus, the following description will be focused on the differences between the heat exchanger (10) of the embodiments and the heat exchanger (10) of the first embodiments.

Figure 8:
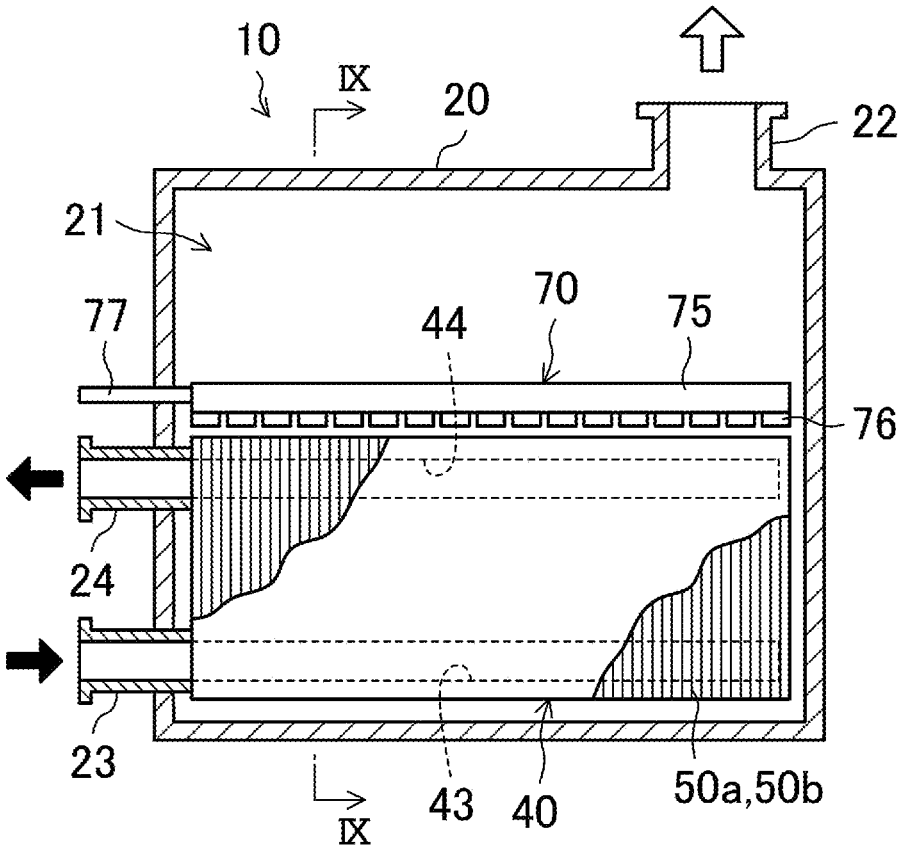
FIG. 8 is a cross-sectional view of a shell-and-plate heat exchanger of third embodiments taken along line VIII-VIII in FIG. 9.
Figure 9:
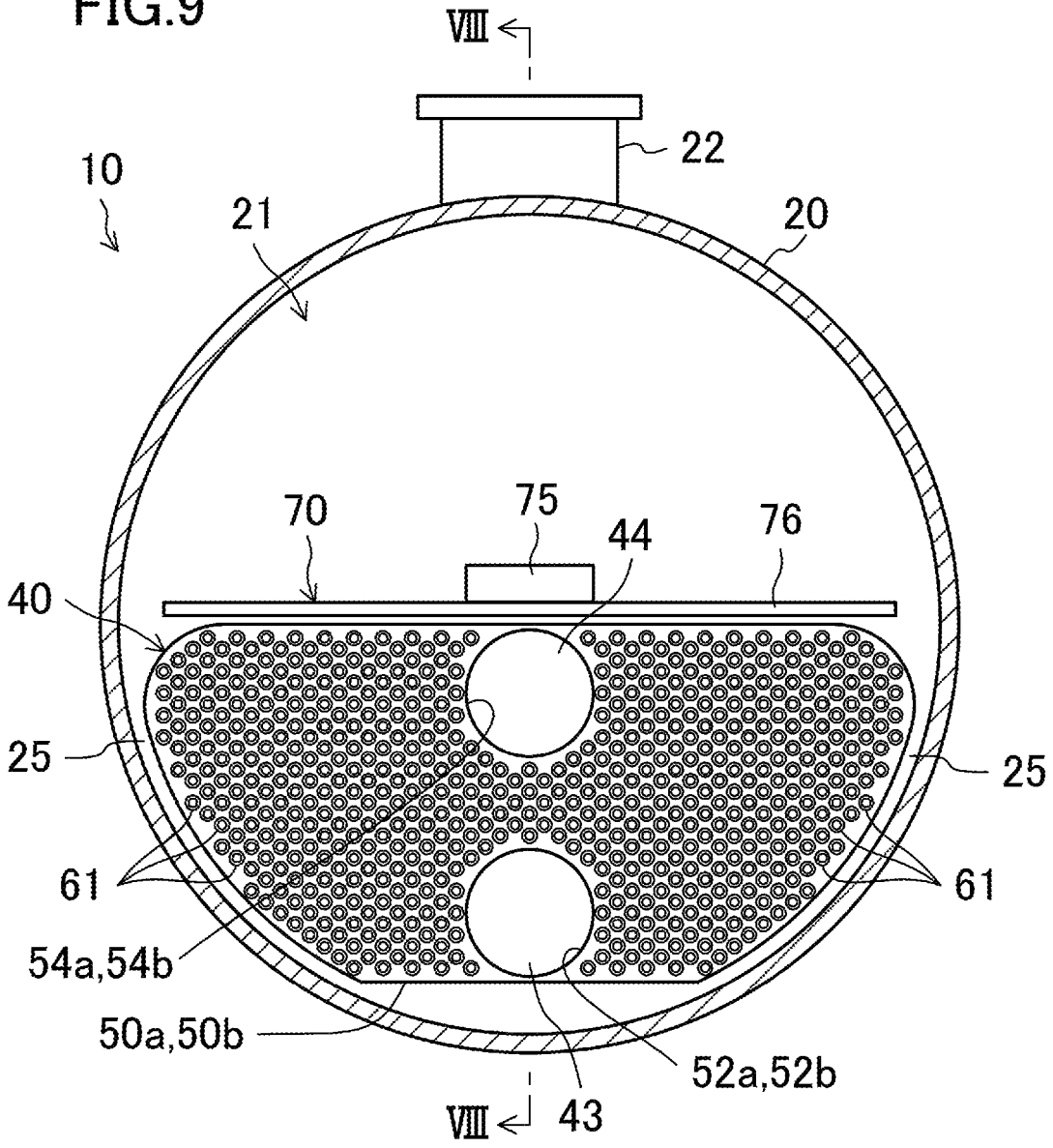
FIG. 9 is a cross-sectional view of the shell-and-plate heat exchanger of the third embodiments taken along line IX-IX in FIG. 8.

As illustrated in FIGS. 8 and 9, the supply structure (70) of the heat exchanger (10) of the embodiments is disposed above the plate stack (40) in the internal space (21) of the shell (20). The supply structure (70) of the embodiments is arranged at a position adjacent to the upper edges of the heat transfer plates (50*a*, 50*b*) constituting the plate stack (40).

—Plate Stack—

As illustrated in FIG. 9, in the heat exchanger (10) of the embodiments, the heat transfer plates (50*a*, 50*b*) constituting the plate stack (40) differ from those of the first embodiments. The first circular hole (55*a*) and the first flat portion (56*a*) are omitted from the first plate (50*a*) of the embodiments. The second circular hole (55*b*) and the second flat portion (56*b*) are also omitted from the second plate (50*b*) of the embodiments.

—Supply Structure—

Figure 10:
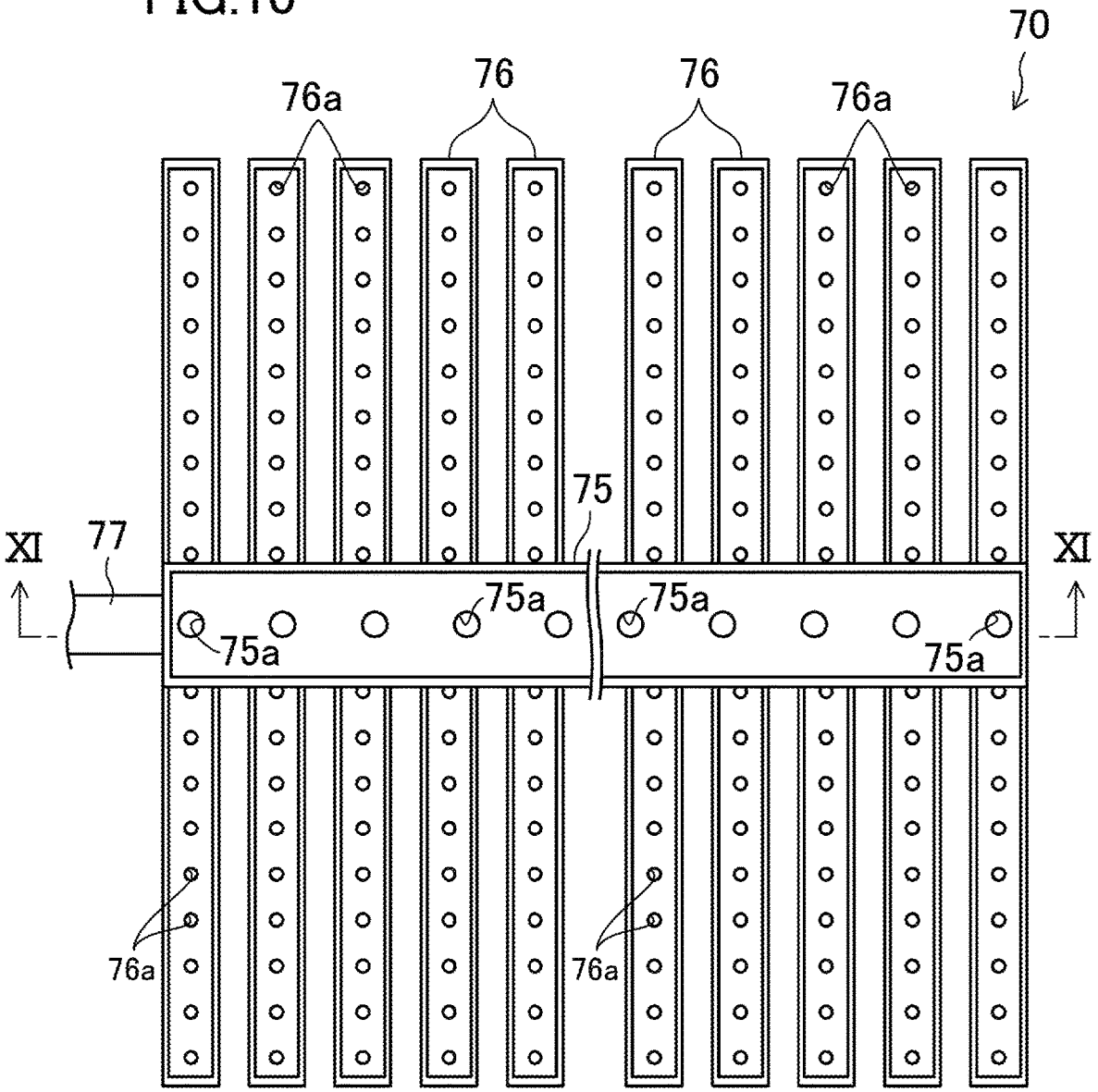
FIG. 10 is a plan view of a supply structure of the third embodiments.
Figure 11:
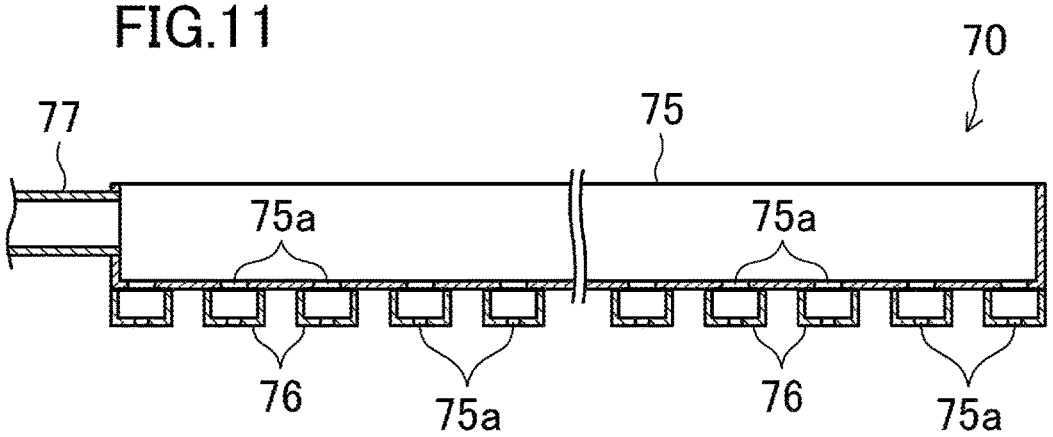
FIG. 11 is a cross-sectional view of the supply structure of the third embodiments taken along line XI-XI in FIG. 10.

As illustrated in FIGS. 10 and 11, the supply structure (70) of the embodiments includes one distribution tray (75), a plurality of disperse trays (76), and one inlet pipe (77).

<Distribution Tray>

The distribution tray (75) is an elongated rectangular parallelepiped member with its upper side open. The length of the distribution tray (75) is substantially equal to the overall length of the plate stack (40), i.e., the length of the heat transfer plates (50*a*, 50*b*) in the stacking direction (see FIG. 8). The distribution tray (75) has a bottom plate with a plurality of distribution holes (75*a*). The number of the distribution holes (75*a*) is equal to the number of the disperse trays (76). Each of the distribution holes (75*a*) is a circular hole that penetrates the bottom plate of the distribution tray (75). The plurality of distribution holes (75*a*) are arranged in a row at regular intervals along the longitudinal direction of the distribution tray (75). The top of the distribution tray (75) may be closed.

<Disperse Tray>

Each of the disperse trays (76) is an elongated rectangular parallelepiped member with its upper side open. The length of each disperse trays (76) is substantially equal to the overall width of the plate stack (40), i.e., the lateral width of the heat transfer plates (50*a*, 50*b*) (see FIG. 9). The disperse trays (76) each have a bottom plate with a plurality of disperse holes (76*a*). Each of the disperse holes (76*a*) is a circular hole that penetrates the bottom plate of the disperse trays (76). The plurality of disperse holes (76*a*) are arranged in a row at regular intervals along the longitudinal direction of the disperse trays (76). The top of each disperse trays (76) may be closed. However, even in that case, the portion of the top of the disperse tray (76) that is directly below the distribution tray (75) needs to be open.

The plurality of disperse trays (76) are positioned below the distribution tray (75). The long side of each disperse tray (76) is substantially orthogonal to the long side of the distribution tray (75). The plurality of disperse trays (76) are arranged at regular intervals in the longitudinal direction of the distribution tray (75), with their long sides parallel to one another. The longitudinal center of each disperse tray (76) is located below a corresponding one of the distribution holes (75*a*). That is, in the supply structure (70), the disperse trays (76) correspond one-to-one with the distribution holes (75*a*).

<Inlet Pipe>

The inlet pipe (77) is a pipe for introducing the refrigerant supplied to the heat exchanger (10) into the distribution tray (75). The inlet pipe (77) is connected to a sidewall on one of short sides of the distribution tray (75) and penetrates this sidewall to be open to the inside of the distribution tray (75).

<Arrangement of Supply Structure>

As described above, the supply structure (70) of the embodiments is disposed above the plate stack (40).

As illustrated in FIG. 8, the supply structure (70) is arranged in the internal space (21) of the shell (20) such that the longitudinal direction of the distribution tray (75) is substantially parallel to the longitudinal direction of the shell (20). The inlet pipe (77) of the supply structure (70) penetrates the left end of the shell (20) in FIG. 8 and extends to the outside of the shell (20). As illustrated in FIG. 9, the distribution tray (75) is disposed at the widthwise center of the plate stack (40).

The disperse trays (76) are arranged along the upper edges of the heat transfer plates (50*a*, 50*b*) constituting the plate stack (40). The bottom surface of each of the disperse trays (76) faces the upper edge of the heat transfer plate (50*a*, 50*b*). The bottom surface of each of the disperse trays (76) is substantially parallel to the upper edge of the heat transfer plate (50*a*, 50*b*).

—Flows of Refrigerant in Supply Structure—

The refrigerant to be supplied to the heat exchanger (10) flows through the inlet pipe (77) of the supply structure (70) into the distribution tray (75). The refrigerant that has flowed into the distribution tray (75) is distributed to each of the disperse trays (76). Specifically, the refrigerant that has flowed into the distribution tray (75) flows down through the distribution holes (75*a*) and into the disperse trays (76) corresponding to the respective distribution holes (75*a*).

The refrigerant that has flowed into each of the disperse trays (76) from the distribution tray (75) flows down through the respective disperse holes (76*a*). Each of the disperse trays (76) provides the refrigerant for substantially the entire width of the plate stack (40). The refrigerant that has passed through the disperse holes of the disperse trays (76) flows into the refrigerant channels (41) of the plate stack (40), and exchanges heat with the heating medium and evaporates while flowing down along the heat transfer plates (50*a*, 50*b*).

Other Embodiments

The heat exchanger (10) of the first to third embodiments may be modified into the following variations. The following variations may be combined or replaced without deteriorating the functions of the heat exchanger (10).

—First Variation—

The heat exchangers (10) of the first to third embodiments may include an eliminator (15). The eliminator (15) is a member for capturing droplets of the liquid refrigerant flowing together with the gas refrigerant. The eliminator (15) is in a thick plate shape made of a stack of metal meshes, for example, and allows the refrigerant to pass through in the thickness direction.

Figure 12:
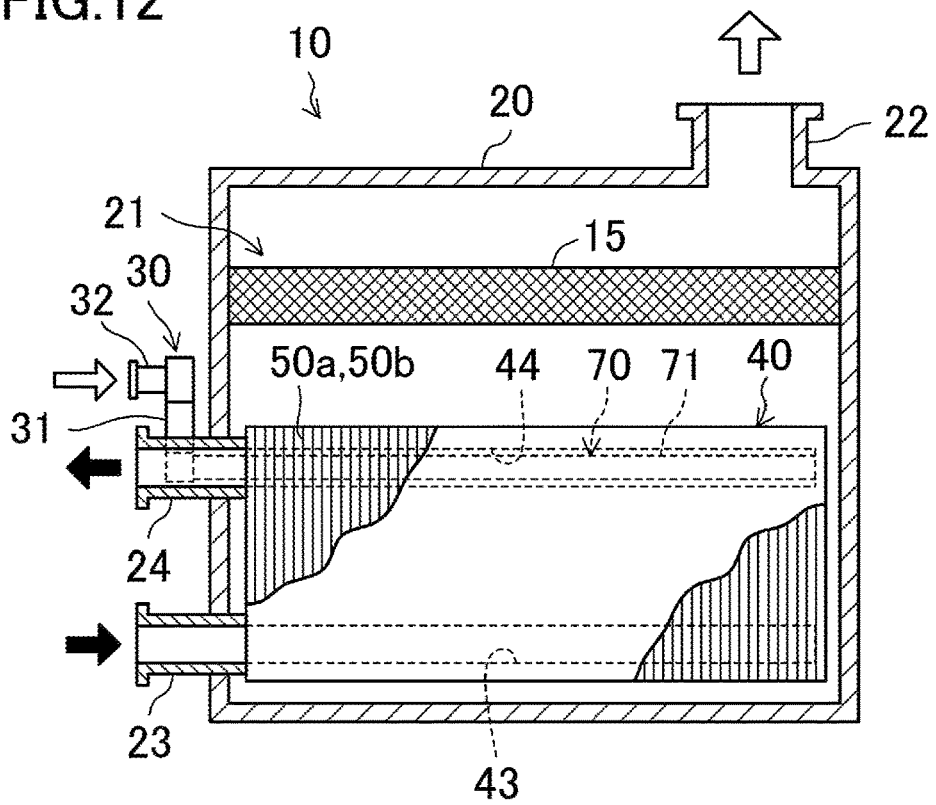
FIG. 12 is a cross-sectional view of a shell-and-plate heat exchanger of a first variation of other embodiments, which is a cross section corresponding to I-I cross section of FIG. 1A.

As illustrated in FIG. 12, the eliminator (15) is housed in the internal space (21) of the shell (20). The eliminator (15) is placed to traverse the internal space (21) of the shell (20) above the plate stack (40).

In the heat exchanger (10) of this variation, the gas refrigerant moving toward the refrigerant outlet (22) from the plate stack (40) passes through the eliminator (15). At this moment, the liquid refrigerant in the form of droplets contained in the gas refrigerant adheres to the eliminator (15) and is separated from the gas refrigerant. The gas refrigerant that has passed through the eliminator (15) flows out of the shell (20) through the refrigerant outlet (22). The liquid refrigerant captured by the eliminator (15) falls down in the form of relatively large droplets.

—Second Variation—

The heat exchangers (10) of the first to third embodiments may include a gas-liquid separator (16).

Figure 13:
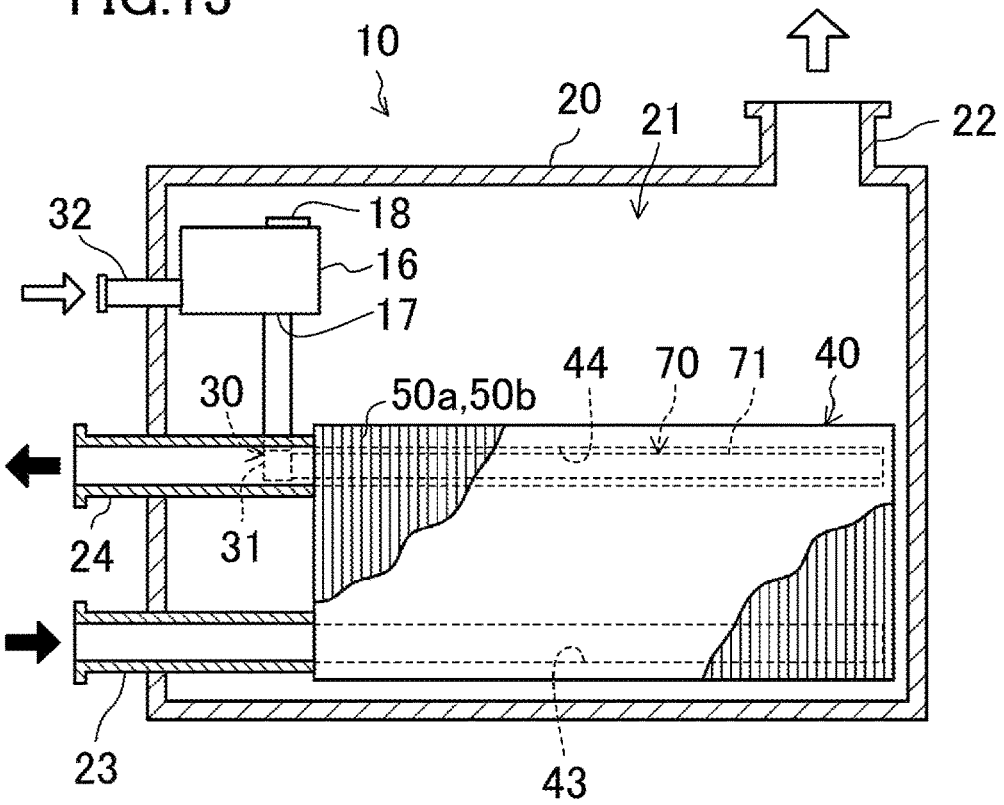
FIG. 13 is a cross-sectional view of a shell-and-plate heat exchanger of a second variation of other embodiments, which is a cross section corresponding to I-I cross section of FIG. 1A.

As illustrated in FIG. 13, the gas-liquid separator (16) is a container-shaped member configured to separate the refrigerant in a gas-liquid two-phase state introduced therein into a liquid refrigerant and a gas refrigerant. A liquid outlet (17) is provided at the bottom of the gas-liquid separator (16). A gas outlet (18) is provided at the top of the gas-liquid separator (16).

The gas-liquid separator (16) is housed in the internal space (21) of the shell (20), and is arranged above the plate stack (40). In the heat exchanger (10) of this variation, the refrigerant inlet (32) is connected to the gas-liquid separator (16). In the heat exchanger (10) of this variation, the refrigerant distributor (30) is housed in the internal space (21) of the shell (20). The liquid outlet (17) of the gas-liquid separator (16) is connected to the distributor body (31) of the refrigerant distributor (30) via a pipe. The gas outlet (18) of the gas-liquid separator (16) is open into the internal space (21) of the shell (20).

The refrigerant in a gas-liquid two-phase state to be supplied to the heat exchanger (10) flows through the refrigerant inlet (32) into the gas-liquid separator (16) and is separated into a liquid refrigerant and a gas refrigerant. Liquid refrigerant in the gas-liquid separator (16) flows through the liquid outlet (17) into the refrigerant distributor (30) and is supplied to the refrigerant channels (41) of the plate stack (40). The gas refrigerant in the gas-liquid separator (16) flows through the gas outlet (18) into the internal space (21) of the shell (20), and flows out of the shell (20) from the refrigerant outlet (22) together with the gas refrigerant evaporated in the plate stack (40).

—Third Variation—

In the heat exchanger (10) of the first to third embodiments, each of the heat transfer plates (50*a*, 50*b*) forming the plate stack (40) may be provided with a corrugated pattern (62) including repeated narrow ridges and grooves instead of the dimples (61).

Figure 14:
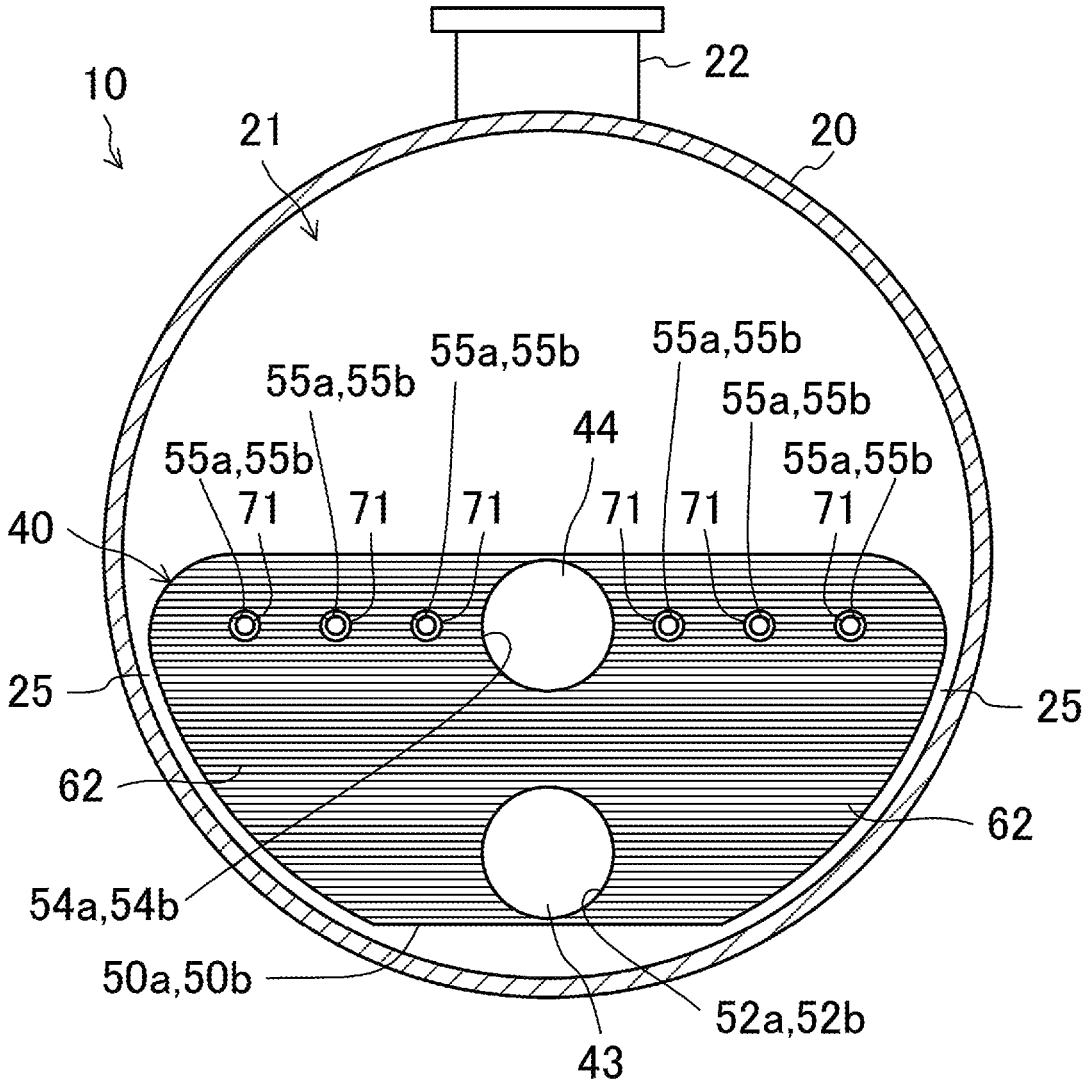
FIG. 14 is a cross-sectional view of a shell-and-plate heat exchanger of a third variation of other embodiments, which is a cross section corresponding to FIG. 2.
Figure 15:
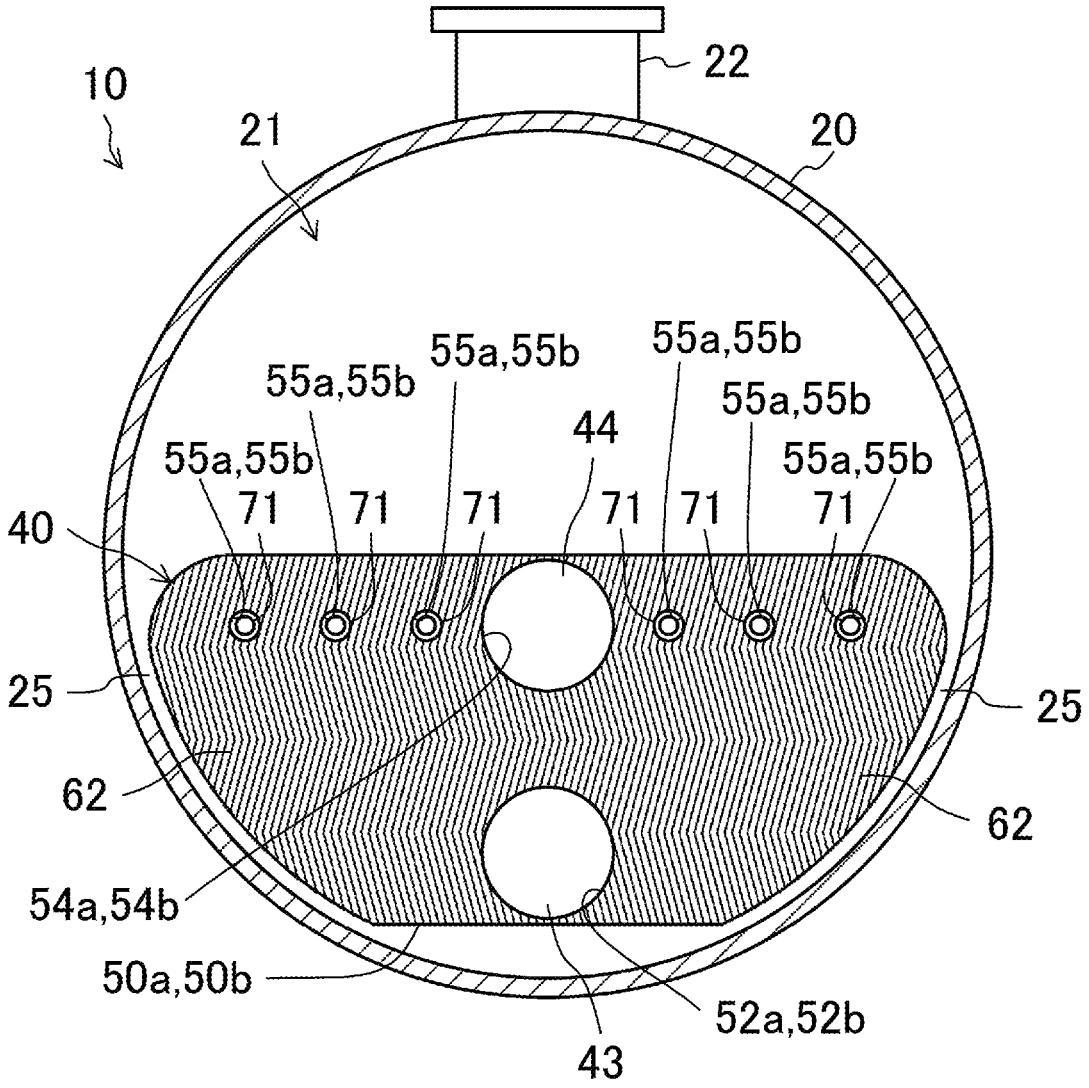
FIG. 15 is a cross-sectional view of a shell-and-plate heat exchanger of a third variation of other embodiments, which is a cross section corresponding to FIG. 2.

For example, as illustrated in FIG. 14, the corrugated pattern (62) formed on the heat transfer plate (50*a*, 50*b*) may have the ridge lines and groove lines extending in the width direction of the heat transfer plate (50*a*, 50*b*). Alternatively, as illustrated in FIG. 15, the corrugated pattern (62) formed on the heat transfer plate (50*a*, 50*b*) may be a pattern in which the ridges and grooves meander to the left and the right. The corrugated pattern (62), similarly to the dimples (61), diffuses the liquid refrigerant flowing down along the heat transfer plate (50*a*, 50*b*) in the lateral direction.

—Fourth Variation—

In the heat exchanger (10) of the first to third embodiments, the shape of the heat transfer plates (50*a*, 50*b*) forming the plate stack (40) is not limited to the semicircular shape.

Figure 16:
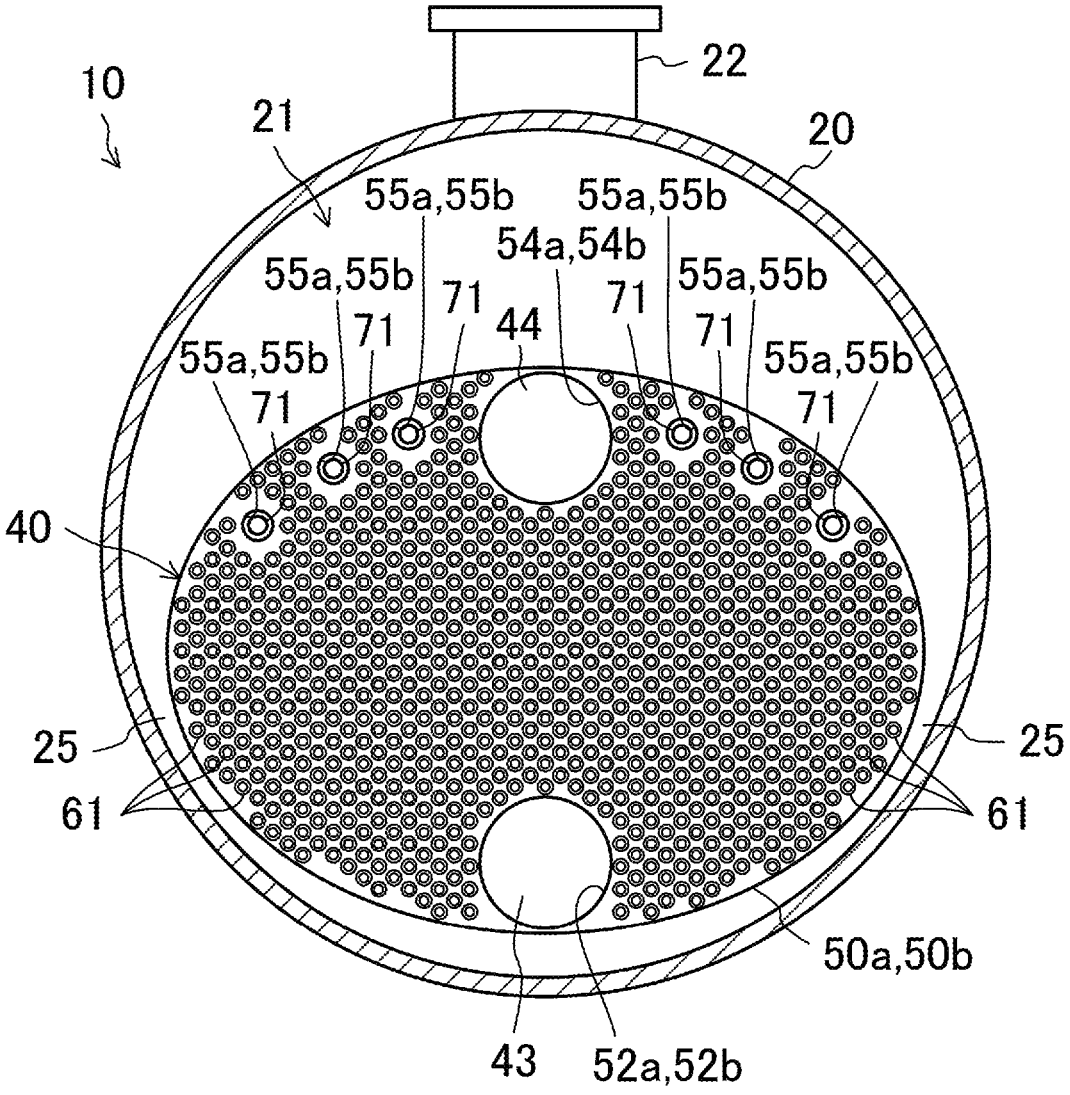
FIG. 16 is a cross-sectional view of a shell-and-plate heat exchanger of a fourth variation of other embodiments, which is a cross section corresponding to FIG. 2.

For example, as illustrated in FIG. 16, the heat transfer plate (50*a*, 50*b*) may have an elliptical shape. Alternatively, although not shown, the heat transfer plate (50*a*, 50*b*) may have a circular shape.

—Fifth Variation—

In the heat exchanger (10) of the first to third embodiments, the heat transfer plates (50*a*, 50*b*) forming the plate stack (40) may be joined together by brazing.

As can be seen from the foregoing description, the present disclosure is useful for a shell-and-plate heat exchanger.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

10 Shell-and-Plate Heat Exchanger
15 Eliminator
16 Gas-Liquid Separator
20 Shell
21 Internal Space
22 Refrigerant Outlet
25 Gap
30 Refrigerant Distributor
40 Plate Stack
41 Refrigerant Channel
42 Heating Medium Channel
43 Heating Medium Introduction Path
44 Heating Medium Emission Path
50*a* First Plate (Heat Transfer Plate)
50*b* Second Plate (Heat Transfer Plate)
70 Supply Structure
71 Refrigerant Introduction Pipe
72 Refrigerant Introduction Channel
73 Supply Hole

What is claimed is:

1. A shell-and-plate heat exchanger, comprising:
a shell forming an internal space; and
a plate stack, disposed in the internal space, comprising heat transfer plates that are stacked and joined together, wherein
the shell-and-plate heat exchanger is configured to allow a refrigerant that has flowed into the internal space to evaporate,
the plate stack forms:
refrigerant channels that communicate with the internal space and through which a refrigerant flows; and
heating medium channels that are blocked from the internal space and through which a heating medium flows, wherein
each of the refrigerant channels is adjacent to an associated one of the heating medium channels with one of the heat transfer plates interposed therebetween,
the shell-and-plate heat exchanger further comprises one or more supply structures that supply the refrigerant to the refrigerant channels such that the refrigerant flows downward,
the one or more supply structures are disposed inside outer peripheries of the heat transfer plates, and
each of the one or more supply structures comprises:
a refrigerant introduction channel that passes through the heat transfer plates and that is surrounded by the heating medium channels; and
supply holes that allow the refrigerant introduction channel to communicate with the refrigerant channels such that the refrigerant is supplied to the refrigerant channels, wherein
the refrigerant introduction channel is formed by joining the heat transfer plates together, and
the supply holes penetrate the heat transfer plates and open on front and back surfaces of the heat transfer plates.

2. The shell-and-plate heat exchanger according to claim 1, wherein two or more of the supply holes are disposed for each of the refrigerant channels.

3. The shell-and-plate heat exchanger according to claim 1, wherein
two or more of the supply structures supply the refrigerant to the refrigerant channels such that the refrigerant flows downward, and
the supply structures are disposed at predetermined intervals along upward-facing edges of the heat transfer plates.

4. The shell-and-plate heat exchanger according to claim 3, wherein
the plate stack comprises:
a heating medium introduction path; and
a heating medium emission path,
the heating medium introduction path and the heating medium emission path: are disposed at a widthwise center portion of the heat transfer plates,
pass through the heat transfer plates, and
communicate with the heating medium channels, and
a same number of the supply structures are disposed in each of left and right side regions of the heating medium introduction path and the heating medium emission path in a width direction of the heat transfer plates.

5. The shell-and-plate heat exchanger according to claim 3, further comprising a refrigerant distributor that distributes the refrigerant to the supply structures.

6. The shell-and-plate heat exchanger according to claim 1, wherein
a liquid refrigerant accumulates at a bottom of the internal space, and
a lower portion of the plate stack is immersed in the liquid refrigerant accumulated at the bottom of the internal space.

7. The shell-and-plate heat exchanger according to claim 1, wherein a gap exists between downward-facing edges of the heat transfer plates and an interior surface of the shell.

8. The shell-and-plate heat exchanger according to claim 1, further comprising a gas-liquid separator that:

separates the refrigerant in a gas-liquid two-phase state into a liquid refrigerant and a gas refrigerant, supplies the liquid refrigerant to the one or more supply structures, and supplies the gas refrigerant to the internal space.

9. The shell-and-plate heat exchanger according to claim 1, wherein the shell comprises a refrigerant outlet at a top of the shell that emits the refrigerant in the internal space out of the shell, the shell-and-plate heat exchanger further comprises an eliminator in the internal space, and the eliminator:

traverses between the plate stack and the refrigerant outlet, and captures droplets of the refrigerant in the refrigerant flowing from the plate stack toward the refrigerant outlet.

* * * * *